US009194017B2

(12) United States Patent
Nakamura et al.

(10) Patent No.: US 9,194,017 B2
(45) Date of Patent: Nov. 24, 2015

(54) HOT-ROLLED STEEL SHEET HAVING EXCELLENT COLD FORMABILITY AND HARDENABILITY AND METHOD FOR MANUFACTURING THE SAME

(75) Inventors: Nobuyuki Nakamura, Hiroshima (JP); Takashi Kobayashi, Kanagawa (JP); Tetsuya Mega, Tokyo (JP)

(73) Assignee: JFE Steel Corporation (JP)

( * ) Notice: Subject to any disclaimer, the term of this patent is extended or adjusted under 35 U.S.C. 154(b) by 426 days.

(21) Appl. No.: 13/635,505

(22) PCT Filed: Mar. 15, 2011

(86) PCT No.: PCT/JP2011/056678

§ 371 (c)(1), (2), (4) Date: Oct. 24, 2012

(87) PCT Pub. No.: WO2011/115279

PCT Pub. Date: Sep. 22, 2011

(65) Prior Publication Data

US 2013/0186526 A1 Jul. 25, 2013

(30) Foreign Application Priority Data

Mar. 19, 2010 (JP) ..... 2010-063545

(51) Int. Cl.

| | |
|---|---|
| ***C21D 8/02*** | (2006.01) |
| ***C22C 38/50*** | (2006.01) |
| ***C22C 38/44*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |
| ***C22C 38/12*** | (2006.01) |
| ***C22C 38/22*** | (2006.01) |
| ***C22C 38/28*** | (2006.01) |
| ***C22C 38/32*** | (2006.01) |
| ***C22C 38/54*** | (2006.01) |
| *C21D 9/00* | (2006.01) |
| *C21D 9/32* | (2006.01) |

(52) U.S. Cl.

CPC ..... *C21D 8/0263* (2013.01); *C21D 8/0226* (2013.01); *C21D 9/46* (2013.01); *C22C 38/001* (2013.01); *C22C 38/02* (2013.01); *C22C 38/04* (2013.01); *C22C 38/06* (2013.01); *C22C 38/12* (2013.01); *C22C 38/14* (2013.01); *C22C 38/22* (2013.01); *C22C 38/28* (2013.01); *C22C 38/32* (2013.01); *C22C 38/44* (2013.01); *C22C 38/50* (2013.01); *C22C 38/54* (2013.01); *C21D 9/0068* (2013.01); *C21D 9/32* (2013.01); *C21D 2211/005* (2013.01); *C21D 2211/009* (2013.01)

(58) Field of Classification Search

CPC ..... C22C 38/54; C22C 38/50; C22C 38/28; C22C 38/14

See application file for complete search history.

(56) References Cited

U.S. PATENT DOCUMENTS

| | | | | |
|---|---|---|---|---|
| 6,544,354 | B1 * | 4/2003 | Kawano et al. | 148/320 |
| 6,632,296 | B2 * | 10/2003 | Yoshinaga et al. | 148/320 |
| 2004/0095052 | A1 * | 5/2004 | Yoshii et al. | 313/407 |
| 2007/0144632 | A1 * | 6/2007 | Toyoda et al. | 148/593 |

FOREIGN PATENT DOCUMENTS

| | | | |
|---|---|---|---|
| JP | 5-098356 | A | 4/1993 |
| JP | 10-265841 | A | 10/1998 |
| JP | 11-181542 | A | 7/1999 |
| JP | 2000-144319 | A | 5/2000 |
| JP | 2001-140037 | A | 5/2001 |
| JP | 2002-309345 | A | 10/2002 |
| JP | 2003-013145 | A | 1/2003 |
| JP | 2007-291468 | A | 11/2007 |

* cited by examiner

*Primary Examiner* — Roy King
*Assistant Examiner* — Jenny Wu
(74) *Attorney, Agent, or Firm* — DLA Piper LLP (US)

(57) ABSTRACT

Hot-rolled steel has a chemical composition containing, by mass %, C: 0.18% or more and 0.29% or less, N: 0.0050% or less, Ti: 0.002% or more and 0.05% or less, B: 0.0005% or more and 0.0050% or less, and appropriately controlled amounts of Si, Mn, P, S, Al, and a tensile strength of 500 MPa or less with a variation in tensile strength of 60 MPa or less throughout a region including the edges in the width direction of the steel sheet, and having excellent cold formability and hardenability.

18 Claims, No Drawings

HOT-ROLLED STEEL SHEET HAVING EXCELLENT COLD FORMABILITY AND HARDENABILITY AND METHOD FOR MANUFACTURING THE SAME

RELATED APPLICATIONS

This is a §371 of International Application No. PCT/JP2011/056678, with an international filing date of Mar. 15, 2011 (WO 2011/115279 A1, published Sep. 22, 2011), which is based on Japanese Patent Application No. 2010-063545, filed Mar. 19, 2010, the subject matter of which is incorporated by reference.

TECHNICAL FIELD

This disclosure relates to a hot-rolled steel sheet that can be ideally used as a material for automotive parts including a gear, a transmission unit and a seat recliner which has excellent cold formability and hardenability, in particular so that a step of spheroidizing annealing can be omitted. Herein, 'a steel sheet' refers to a steel plate or a steel strip.

BACKGROUND

In general, automotive parts including a gear, a transmission unit and a seat recliner are manufactured from a hot-rolled steel sheet which is a carbon steel for machine structural use conforming to JIS G 4051, by forming the steel sheet into a specified shape by using cold forming and then giving the resulting work a specified hardness by performing a quenching treatment. Therefore, there is a demand for a hot-rolled steel sheet that has excellent cold formability and hardenability when in a raw material state. To meet this demand, Japanese Unexamined Patent Application No. 2002-309345 discloses a hot-rolled steel sheet having excellent impact strength after quenching treatment has been performed, which has a chemical composition containing, by mass %, C: 0.10% or more and 0.37% or less, Si: 1% or less, Mn: 2.5% or less, P: 0.1% or less, S: 0.03% or less, sol.Al: 0.01% or more and 0.1% or less, N: 0.0005% or more and 0.0050% or less, Ti: 0.005% or more and 0.05% or less, and B: 0.0003% or more and 0.0050% or less, in which the relationship $B-(10.8/14)N^*\geq 0.0005\%$ is satisfied, where $N^*=N-(14/48)Ti$, and where $N^*=0$ in the case where $N-(14/48)Ti\leq 0$, in which the mean particle diameter of TiN, which is a precipitate in steel, is 0.06 μm or more and 0.30 μm or less, and in which the mean grain diameter of prior austenite is 2 μm or more and 25 μm or less after quenching treatment has been performed. The method disclosed by JP '345 is described as being capable of providing the hot-rolled steel sheet described above by hot-rolling the steel having the chemical composition described above, in which the coiling temperature is 720° C. or lower.

Japanese Unexamined Patent Application Publication No. 5-98356 discloses a method for manufacturing a tempering-free-type high carbon thin steel sheet having a thickness of 4 mm or less and having a tensile strength (TS) and an elongation (El) satisfying the relationship $TS\times El\geq 16000$ MPa % by cold-rolling steel having a chemical composition containing, by mass %, C: 0.15% or more and 0.40% or less, Si: 0.35% or less, Mn: 0.6% or more and 1.5% or less, P: 0.030% or less, S: 0.020% or less, Ti: 0.005% or more and 0.1% or less, sol.Al: 0.01% or more and 0.20% or less, N: 0.0020% or more and 0.012% or less, and B: 0.0003% or more and 0.0030% or less with a rolling reduction of 30% or more and 80% or less and then by using box annealing. The steel sheet disclosed by JP '356 is described as having excellent formability after heat treatment (quenching) has been performed and excellent toughness even after quenching treatment has been performed so that tempering can be omitted.

Japanese Unexamined Patent Application Publication No. 2000-144319 discloses a method for manufacturing a thin steel sheet having excellent formability and hardenability by hot-rolling a steel slab having a chemical composition containing, by mass %, C: 0.05% or more and 0.20% or less, Si: 0.1% or less, Mn: 0.8% or more and 2.0 or less, P: 0.02% or less, S: 0.02% or less, N: 0.005% or less, B: 0.0003% or more and 0.004% or less, Al: 0.01% or more and 0.10%, in which the relationship sol.Al (%)≥9.6×N (%) is satisfied, and in which the relationship Ti (%)≤3.4×N (%) is satisfied, and then coiling the resulting hot-rolled steel sheet at a coiling temperature of 600° C. or higher. The method disclosed by JP '319 is described as being capable of providing a steel sheet having sufficient formability to be applied to forming including press forming and being able to easily achieve high strength through quenching treatment after forming has been performed.

However, the problem that a steel sheet must have not only sufficient cold formability for severe cold forming but also excellent hardenability is left unsolved by JP '345, JP '356 and JP '319, because severe cold forming including fine blanking and cold forging is not taken into account in those publications, and because the steel sheets described above tend to become too hard and decrease in cold formability, as the ferrite grain of the steel sheets tends to become excessively fine and the pearlite fraction tends to become excessively large. Moreover, when the steel sheets described above undergo cold forming including fine blanking, there is an increase in frequency of maintenance including die replacement due to increased wear of dies, which results in an increase in the manufacturing cost of parts. Furthermore, an increase in hardenability tends to be accompanied by a decrease in the uniformity of the hardness in the width direction of the steel sheet due to an excessive hardening at the edges of the steel sheet, which results in a decrease in steel sheet yield.

It could therefore be helpful to provide a hot-rolled steel sheet having not only high excellent cold formability, but also excellent hardenability and a method for manufacturing the steel sheet. Moreover, it could be helpful to provide a hot-rolled steel sheet having not only uniform strength throughout almost the entire region including edges in the width direction, but also excellent cold formability and hardenability.

Herein, 'a hot-rolled steel sheet' refers to a thin steel sheet having a thickness of 2.0 mm or more and 9.0 mm or less. Moreover, herein, 'a steel sheet has excellent cold formability' will refer to a steel material (steel sheet) that has a Rockwell hardness of 80 or less in terms of HRB or a tensile strength (TS) of 500 MPa or less before cold forming has been performed.

Herein, 'a steel sheet has excellent hardenability' refers to a steel sheet that has a Vickers hardness of 420 HV or more (in the case of induction quenching) or of 350 HV or more (in the case of controlled atmospheric quenching). Moreover, herein, 'strength is uniform throughout almost the entire region including both edges in the width direction' refers to the case where the difference between maximum and minimum tensile strength is 60 MPa or less throughout almost the entire region including both edges in the width direction of a steel sheet (the region that is on the inner side 5 mm from the edges).

Herein, 'controlled atmospheric quenching' refers to a quenching method including oil-quenching after a steel sheet has been heated in an atmosphere in which carbon potential is controlled.

SUMMARY

We discovered that a steel sheet can have not only excellent hardenability, but also excellent cold formability so that the occurrence of fractures can be reduced when the steel sheet undergoes severe cold forming including fine blanking and cold forging and so that the wear of dies can be reduced when parts are manufactured, by limiting the carbon content of the steel sheet to 0.18 mass % or more and 0.29 mass % or less, additionally, by adjusting the contents of Mn, Al, Ti and B within the appropriate limits, moreover, by making the microstructure of the steel sheet consist of the ferrite and the pearlite in which the mean grain diameter of the ferrite is 7.0 μm or more and 15.0 μm or less and in which the volume fraction of the ferrite is 50% or more with respect to the whole microstructure. Moreover, we found that the steel sheet can have the microstructure described above and the variation in the tensile strength throughout almost the entire region in the width direction of the steel sheet can be controlled to 60 MPa or less, by controlling the finishing temperature of hot rolling, the cooling rate between the end of finish rolling and coiling and the coiling temperature to be within appropriate ranges.

We thus provide:

(1) A hot-rolled steel sheet having a tensile strength of 500 MPa or less and having excellent cold formability and hardenability, the steel sheet having a chemical composition containing, by mass %, C: 0.18% or more and 0.29% or less, Si: 1% or less, Mn: 1.5% or less, P: 0.1% or less, S: 0.03% or less, sol.Al: 0.1% or less, N: 0.0050% or less, Ti: 0.002% or more and 0.05% or less, B: 0.0005% or more and 0.0050% or less, and the balance being Fe and inevitable impurities and a microstructure in which the fraction of ferrite and pearlite with respect to the whole microstructure is 95% or more in terms of the sum of the volume fraction of both components, in which the mean grain diameter of the ferrite is 7.0 μm or more and 15.0 μm or less, and in which the volume fraction of the ferrite with respect to the whole microstructure is 50% or more.

(2) The hot-rolled steel sheet according to item (1), further having a chemical composition containing, by mass %, one or both of Nb and V: 0.1% or less in total.

(3) The hot-rolled steel sheet according to item (1) or (2), further having a chemical composition containing, by mass %, one or more of Ni, Cr and Mo: 1.5% or less in total.

(4) The hot-rolled steel sheet according to any one of items (1) to (3), further having a chemical composition containing, by mass %, one or both of Sb and Sn: 0.1% or less in total.

(5) The hot-rolled steel sheet according to any one of items (1) to (4) having a variation in the tensile strength ΔTS of 60 MPa or less throughout the region that is on the inner side 5 mm from the edges in the width direction of a steel sheet.

(6) A method for manufacturing a hot-rolled steel sheet having excellent cold formability and hardenability, including hot-rolling a steel having a chemical composition containing, by mass %, C: 0.18% or more and 0.29% or less, Si: 1% or less, Mn: 1.5% or less, P: 0.1% or less, S: 0.03% or less, sol.Al: 0.1% or less, N: 0.0050% or less, Ti: 0.002% or more and 0.05% or less, B: 0.0005% or more and 0.0050% or less, and the balance being Fe and inevitable impurities with a finishing temperature of 800° C. or higher and 900° C. or lower and thereafter, cooling the resulting hot-rolled steel sheet at a mean cooling rate of 20° C./s or less, and coiling the resulting hot-rolled steel sheet at a coiling temperature CT of 500° C. or higher.

(7) The method for manufacturing a hot-rolled steel sheet according to item (6), the steel further having a chemical composition containing, by mass %, one or both of Nb and V: 0.1% or less in total.

(8) The method for manufacturing a hot-rolled steel sheet according to item (6) or (7), the steel further having a chemical composition containing, by mass %, one or more of Ni, Cr and Mo: 1.5% or less in total.

(9) The method for manufacturing a hot-rolled steel sheet according to any one of items (6) to (8), the steel further having a chemical composition containing, by mass %, one or both of Sb and Sn: 0.1% or less in total.

Incidentally, in the method according to any one of items (6) to (9), it is preferable that the edges of the steel be heated with edge heaters when hot rolling is being performed and/or that the edges of the obtained hot-rolled steel sheet be covered with edge covers during cooling, which is performed after hot rolling has been performed, and/or that the coiled hot-rolled steel sheet be covered with a coil cover during cooling, which is performed after coiling has been performed.

It is possible to manufacture easily and at a low cost a hot-rolled steel sheet having not only excellent cold formability but also excellent hardenability, which results in a significant industrial advantage. Moreover, the hot-rolled steel sheet has not only excellent cold formability and hardenability, but also uniform tensile strength throughout almost the entire region including both edges in the width direction, which results in a significant economic advantage by enabling materials for parts to be obtained in a high yield.

DETAILED DESCRIPTION

First, the reasons for the limitations of the chemical composition of the steel sheets will be described. Hereinafter, mass % shall be denoted by %, unless otherwise noted.

C: 0.18% or More and 0.29% or Less

C is a chemical element that is important to improve hardenability of steel and achieve the specified strength (hardness) after quenching treatment has been performed. A Carbon content of 0.18% or more is necessary to realize this effect. It is difficult to achieve the specified strength (hardness) after quenching treatment has been performed if the carbon content is less than 0.18%. On the other hand, an excessive carbon content of more than 0.29% decreases the fraction of ferrite, which results in a decrease in ductility and makes it impossible to achieve the specified excellent cold formability in the case where a step of spheroidizing annealing is omitted. Therefore, the C content is set to be 0.18% or more and 0.29% or less, preferably 0.20% or more and 0.26% or less.

Si: 1% or Less

Si is a chemical element effective not only for improving hardenability of steel, but also for increasing the strength of steel by solid solution in steel. Although it is preferable that the Si content be 0.01% or more to realize this effect, an excessive Si content of more than 1% significantly increases the hardness of steel, which makes it impossible to achieve the specified excellent cold formability. Therefore, the Si content is set to be 1% or less, preferably 0.50% or less.

Mn: 1.5% or Less

Mn is a chemical element that is effective not only for improving the hardenability of steel, but also for increasing the strength of steel by solid-solution strengthening. Although it is preferable that the Mn content be 0.2% or more to realize this effect, an excessive Mn content of more than 1.5% increases the hardness of steel too much, which makes it impossible to achieve the specified excellent cold formability. Therefore, the Mn content is set to be 1.5% or less, preferably 0.2% or more and 1.0% or less.

P: 0.1% or Less

As P is a chemical element that tends to segregate on grain boundaries in steel and has a harmful influence on the ductility and toughness of steel, it is preferable that the P content be decreased as much as possible. In particular, an excessive P content of more than 0.1% causes grain boundary embrittlement, which results in a decrease in ductility and toughness and makes it impossible to achieve excellent cold formability and excellent toughness after quenching treatment has been performed. Therefore, the P content is set to be 0.1% or less, preferably 0.05% or less.

S: 0.03% or Less

As S is a chemical element that forms sulfides in steel and has a harmful influence on the ductility and toughness of steel, it is preferable that the S content be decreased as much as possible. In particular, an excessive S content of more than 0.03% decreases cold formability and toughness after quenching treatment has been performed. Therefore, the S content is set to be 0.03% or less, preferably 0.02% or less.

Sol.Al: 0.1% or Less

Al is a chemical element that works as a deoxidizing agent and contributes to the refining of austenite grains. It is preferable that the Al content be 0.001% or more to realize this effect. On the other hand, an excessive Al content of more than 0.1% causes excessive refining of austenite grains during heating that occurs when quenching treatment is performed and promotes nucleation of the ferrite during cooling that occurs when quenching treatment is performed, which makes it impossible to achieve the specified hardness after quenching treatment has been performed and results in a decrease in toughness after quenching treatment has been performed. Therefore, the sol.Al content is set to be 0.1% or less, preferably 0.07% or less.

N: 0.0050% or Less

N is a chemical element that increases the strength of steel by solid solution and is effective for suppressing the increase in size of austenite grains by forming nitrides with Ti and B. Although it is preferable that the N content be 0.0005% or more to realize this effect, an excessive N content of more than 0.0050% causes significant formation of AlN in addition to TiN and BN and causes excessive reduction in size of austenite grains during heating that occurs when quenching treatment is performed and promotes nucleation of the ferrite during cooling that occurs when quenching treatment is performed. This makes it difficult to achieve the specified hardness after quenching treatment has been performed and results in a decrease in toughness after quenching treatment has been performed. Therefore, N content is set to be 0.0050% or less, preferably 0.0040% or less.

Ti: 0.002% or More and 0.05% or Less

Ti is a chemical element that contributes to the improvement of hardenability by forming TiN to trap N and by suppressing the formation of BN to secure the specified amount of solute B and increases the impact strength (toughness) after quenching treatment has been performed by suppressing the increase in size of austenite grains of steel. It is necessary that the Ti content be 0.002% or more to realize this effect. On the other hand, an excessive Ti content of more than 0.05% promotes formation of TiC, which results in a decrease in cold formability due to an increase in hardness and may make it impossible to achieve the specified hardness after quenching treatment has been performed because of a decrease in hardenability caused by an excessive reduction in size of austenite grains. Therefore, the Ti content is set to be 0.002% or more and 0.05% or less, preferably 0.005% or more and 0.03% or less.

B: 0.0005% or More and 0.0050% or Less

B is a chemical element that, in a small amount, is effective for significantly improving hardenability of steel by segregating on austenite grain boundaries. It is necessary that the B content be 0.0005% or more to realize this effect. On the other hand, an excessive B content of more than 0.0050% decreases operability due to an increase in the hot rolling load and makes it impossible to realize an effect commensurate with the added amount of B due to saturation of the effect of improving hardenability. Therefore, the B content is set to be 0.0005% or more and 0.0050% or less, preferably 0.0010 or more and 0.0040% or less.

The chemical composition described above is the basic composition. The hot-rolled steel sheet may further have any or all of the following chemical compositions: one or both of Nb and V, 0.1% or less in total; one or more of Ni, Cr and Mo, 1.5% or less in total; and one or both of Sb and Sn; 0.1% or less in total.

One or Both of Nb and V: 0.1% or Less in Total

As Nb and V are both chemical elements effective for improving toughness after quenching treatment has been performed by suppressing the increase in size of austenite grains during heating that occurs when quenching treatment is performed, they may be added as needed. Although it is preferable that the content of Nb and V be 0.005% or more in total to realize this effect, an excessive content of Nb and V of more than 0.1% in total decreases ductility due to excessive hardening of the steel sheet, which results in a significant decrease in cold formability. Therefore, the upper limit of the total content of Nb and V is set to be 0.1%.

One or More of Ni, Cr and Mo; 1.5% or Less in Total

As Ni, Cr and Mo are all chemical elements that are effective for improving hardenability, they may be added in the case where improvement of hardenability is necessary. Although it is preferable that the content of Ni, Cr and Mo be 0.1% or more in total to realize this effect, an excessive content of Ni, Cr and Mo of more than 1.5% in total decreases ductility due to excessive hardening of the steel sheet, which results in a significant decrease in cold formability. Therefore, the upper limit of the total content of Ni, Cr and Mo is set to be 1.5%. One or both of Sb and Sn; 0.1% or less in total As Sb and Sn are both chemical elements that contribute to preventing a decrease in hardenability due to decarburization or nitriding during controlled atmospheric quenching or carbonitriding treatment is performed, Sb and Sn may be added as needed. Although it is preferable that the content of Sb and Sn be 0.005% or more in total to realize this effect, an excessive content of Sb and Sn of more than 0.1% in total decreases ductility after quenching treatment has been performed. Therefore, it is preferable that the upper limit of the total content of one or both of Sb and Sn be set to be 0.1%.

The remainder of the steel other than chemical elements described above consists of Fe and inevitable impurities.

Second, the reasons for the limitations of the microstructure of the steel sheets will be described.

The steel sheet has a microstructure in which the fraction of ferrite and pearlite with respect to the whole microstructure is 95% or more in terms of the sum of the volume fractions of both components. The ferrite phase has a mean grain diameter of 7.0 μm or more and 15.0 μm or less and a fraction with respect to the whole microstructure of 50% or more in terms of volume fraction. In the case where the mean grain diameter of the ferrite is less than 7.0 μm, there is a decrease in cold formability due to significant hardening of the steel sheet. On the other hand, in the case where the mean grain diameter of the ferrite is more than 15.0 μm, there is a decrease in cold formability due to the inhomogeneous distribution of the ferrite and the pearlite. Therefore, the mean grain diameter of the ferrite is set to be 7.0 μm or more and 15.0 μm or less, preferably 7.5 μm or more and 12.5 μm or less. The grain size of the pearlite is almost the same as that of the ferrite. The mean grain diameter of the ferrite is to be calculated by using data obtained through a cutting method and image analysis conforming to JIS after the microstructure has been observed through an optical microscope and the phases have been identified.

In the case where the fraction of ferrite is less than 50%, there is a decrease in cold formability, because there is a decrease in ductility due to an excessive fraction of pearlite. Although the upper limit of the fraction of ferrite is not set in particular, it is preferable that the fraction of ferrite is 70% or less, because burrs tend to occur when fine blanking is performed in the case where the fraction of ferrite is more than 70%. Therefore, the fraction of ferrite is set to be 50% or more, preferably 50% or more and 65% or less.

Although the steel sheet basically has a microstructure consisting of a ferrite and a pearlite, other kinds of components including bainite and martensite may be contained in the microstructure to the extent that there is no negative effect on the characteristics of the steel sheet, that is, if the total fraction of the other kinds of components with respect to the whole microstructure is 5% or less in terms of volume fraction. That is to say, the steel sheet has a microstructure in which the fraction of ferrite and pearlite with respect to the whole microstructure is 95% or more in terms of the sum of the volume fractions of both components.

Third, a preferable method for manufacturing the steel sheet will be described.

The steel material described above is made into a hot-rolled steel sheet through a hot rolling process. Although there is not a necessity to limit the method for manufacturing the steel material, it is preferable that the molten steel having a chemical composition described above be smelted by using a common smelting method such as a converter method or an electric furnace method and be made into a steel material such as a slab by using a common casting method such as a continuous casting method. Although it is preferable that the steel material be cast by using a continuous casting method in which macro segregation of chemical elements can be avoided, there is no problem if an ingot-making method or thin slab casting method is used.

The obtained steel material undergoes a hot rolling process which consists of hot rolling, cooling after hot rolling and coiling. As for a heating method for hot rolling, not only a method in which the steel material is cooled down to room temperature before being re-heated, but also an energy-saving process including a method in which the steel material is charged into a heating furnace in a warm state without being cooled down to room temperature and hot direct rolling or in-line rolling in which the steel material is hot-rolled immediately after heat insulation for a short time may be applied without problems. It is preferable that the heating temperature be 1000° C. or higher and 1280° C. or lower in the case where the steel material is re-heated. In the case where the heating temperature is higher than 1280° C., growth of scale is significant, because the surface of the steel material is oxidized. In the case where the heating temperature is lower than 1000° C., rolling may be difficult due to a significant increase in rolling load.

The hot rolling process includes heating the steel material described above, or optionally without heating, then making the steel material hot-rolled steel sheet of the specified size and shape by using hot rolling which consists of rough rolling and finish rolling, then cooling the hot-rolled steel sheet at a specified cooling rate down to the specified coiling temperature, and then coiling the hot-rolled steel sheet at the coiling temperature.

As long as a sheet bar of the specified size can be obtained, it is not necessary to limit conditions for rough rolling which is included in hot rolling. The sheet bar may be heated by using a heating means such as a sheet bar heater to adjust the finish rolling temperature to the specified temperature. A reduction in temperature at the edges of the hot-rolled steel sheet may be suppressed by using a means of heating edges such as an edge heater after rough rolling is being performed.

The condition for finish rolling is that the finishing temperature FT be 800° C. or higher and 900° C. or lower. The obtained hot-rolled steel sheet, after hot rolling (finish rolling), is to be cooled at a cooling rate of 20° C. or less down to a coiling temperature CT and then is to be coiled at a coiling temperature CT of 500° C. or higher.

Finishing Temperature FT: 800° C. or Higher and 900° C. or Lower

In the case where a finishing temperature of finish rolling (finishing temperature FT) is lower than 800° C., austenite grains become too small and the grain size of the ferrite, which is generated while cooling is performed after finish rolling, is decreased too much, which results in a decrease in cold formability due to excessive hardening of the steel sheet. On the other hand, in the case where finishing temperature FT is higher than 900° C., austenite grains become larger and there is an increase in hardenability, and so, generation of ferrite is suppressed during cooling, which is performed after finish rolling, which results in a decrease in cold formability due to an excessive increase in the fraction of pearlite. Therefore, the finishing temperature of finish rolling (finishing temperature FT) is set to be 800° C. or higher and 900° C. or lower.

In addition, a reduction in temperature at the edges of the hot-rolled steel sheet may be suppressed by using a means of heating edges such as an edge heater before finish rolling is being performed.

Cooling Rate after Hot Rolling has been Performed CR: 20° C./s or Less

In the case where a mean cooling rate CR between the end of hot rolling (finish rolling) and coiling temperature CT is more than 20° C./s, generation of the ferrite is suppressed, and so, the specified fraction of ferrite cannot be achieved, which makes it impossible to achieve the specified excellent cold formability. Moreover, in the case where a mean cooling rate CR after hot rolling has been performed is more than 20° C./s, influence on a microstructure is large and there is a decrease in homogeneity of the microstructure in the width direction of the steel sheet, in particular, it is difficult to achieve the microstructure having the ferrite with the specified fraction at the edge portions, which results in an increase in the variation in hardness in the width direction of the steel sheet. Therefore, a mean cooling rate after hot rolling has been performed is set to be 20° C./s or less. In addition, although it is preferable that a mean cooling rate after hot rolling has been performed be as small as possible from the viewpoint of improvement of cold formability and suppressing the variation in strength in the width direction, it is preferable that a mean cooling rate after hot rolling has been performed be around 5° C./s or more and 15° C./s or less. It is preferable that a cooling means such as a water spray be applied to the cooling described above. Generation of surface scale on the steel sheet can be suppressed by using a cooling means such as a water spray.

In addition, a reduction in temperature at the edges of the hot-rolled steel sheet may be suppressed by using a means of heat insulation such as an edge cover during cooling, which is performed after finish rolling has been performed.

Coiling Temperature CT: 500° C. or Higher

In the case where a coiling temperature is lower than 500° C., grains of the ferrite and the pearlite are made smaller, and so, the distance between pearlite lamellas is small and the steel sheet becomes hardened due to generation of bainite and martensite, which results in a decrease in cold formability. Therefore, the coiling temperature CT is set to be 500° C. or higher. Although it is not necessary to define the upper limit of the coiling temperature, it is preferable that a coiling temperature be 750° C. or lower. In the case where a coiling temperature is higher than 750° C., there is a significant deterioration in the surface characteristics of the steel sheet due to the generation of scale on the surface of the steel sheet and it is difficult to achieve the specified hardness (strength) due to decarburization of the surface of the steel sheet. Therefore, it is preferable that a coiling temperature be 750° C. or lower, more preferably 700° C. or lower. In addition, the coiled hot-rolled steel sheet may be covered with a coil cover during cooling, which is performed after coiling has been performed.

EXAMPLES

The molten steels having chemical compositions given in Table 1 were smelted by using a converter and cast into slabs (steel materials) by a continuous casting method. Then, the slabs (steel materials) were heated to 1250° C., and hot-rolled with finishing temperature FT's given in Table 2. Then, the hot-rolled steel sheets were cooled at mean cooling rates CR's given in Table 2 down to coiling temperatures, coiled at coiling temperatures CT's given in Table 2, and hot rolled steel sheets (hot-rolled strips) having a thickness of 4.0 mm were obtained. The finishing temperature FT, the mean cooling rate CR and the coiling temperature CT were determined on the basis of the surface temperature of the steel sheet.

Microstructure observations, tensile tests, die wear tests, and hardenability tests were carried out with the test pieces derived from the obtained hot-rolled steel sheets. The test methods were as follows.

(1) Microstructure Observation

The microstructure was identified and the mean grain diameter and the fraction (volume fraction %) of the ferrite were calculated by using the data observed through an image analyzer, analyzing the photographs taken by using an optical microscope (at 400-times magnification) at 10 points in the domain around the central position in the thickness direction of a test piece for microstructure observation which was taken from the central position in the width direction of the obtained hot-rolled steel sheet and which was polished and corroded. The mean grain diameter of the ferrite was defined as an arithmetic mean of equivalent circle diameters, where each equivalent circle diameter was calculated from the observed area of each ferrite grain.

(2) Tensile Test

Tensile tests were carried out while conforming to JIS Z 2241 with JIS No. 5 tensile test pieces cut out of certain positions in the width direction of the obtained hot-rolled steel sheet so that the tensile direction was in the rolling direction to derive the tensile strength TS of each of the certain positions in the width direction. The test pieces were cut out of the positions of center, a quarter, one-eighth and three-eighths of the width and a position 15 mm from the edge in the width direction of the hot-rolled steel sheet. The variation in strength in the width direction of each steel sheet was defined as the difference ΔTS between the maximum and the minimum among the derived values of TS at certain positions in the width direction. The test piece for the edge position was cut out of the steel sheet so that the parallel part of the test piece contained the portion on the inner side 5 mm from the edge.

(3) Die Wear Test

The influence on die life was estimated by the number of fine blanking tests (the number of punching operations) which were completed without breakage of a punch tooth with a flat test piece of 50 mm×50 mm cut out of the central position in the width direction of the obtained hot-rolled steel sheet. Cases where the number of punching operations was 1000 or more were estimated as successful cases (o), which means the influence on the die life is small, and the other cases were estimated as failure cases (χ). The conditions for the fine blanking test were as follows: the diameter of the punch was 10 mmφ, and the clearance on one side was 0.02 mm.

(4) Hardenability Test

A hardenability test was carried out with a flat test piece cut out of the obtained hot-rolled steel sheet. Two kinds of hardenability test were carried out, that is, one was controlled atmospheric quenching and another was induction quenching. The hardness HV of the steel sheet after quenching treatment had been performed was defined as an arithmetic mean of the hardness measured through a Vickers hardness testing machine (load: 200 gf (testing force: 1.97 N)) at 10 points in the surface layer (at a depth of 0.1 mm) of the test piece after quenching treatment had been performed. Cases where the hardness HV after quenching treatment had been performed was 350 HV or more for controlled atmospheric quenching and cases where the hardness HV after quenching treatment had been performed was 420 HV or more for induction quenching were estimated as successful cases (o), which means the test piece has excellent hardenability, and the other cases were estimated as failure cases (χ).

(i) Controlled Atmospheric Quenching Test

Quenching treatment was carried out with a flat test piece of 50 mm×50 mm. The conditions of the quenching treatment were as follows: the test piece was charged into the atmosphere that is a mixture of RX gas and air in which the carbon potential was equivalent to the C content of the steel, held at 900° C. for one hour, and then dipped into the oil at 50° C. and stirred.

(ii) Induction Quenching

Quenching treatment was carried out with a flat test piece of 30 mm×100 mm. The conditions of the quenching treatment were as follows: the test piece was heated up to 900° C. in 4 seconds by a moving induction coil heater the frequency of which was 100 kHZ, and then cooled with water with a holding time of 0 seconds, which means cooling started immediately after the temperature of the test piece had reached 900° C.

The obtained results of the tests described above are given in Table 3.

TABLE 1

| Steel No. | Chemical Composition (mass %) C | Si | Mn | P | S | Al | N | Ti | B | Nb, V | Sum | Ni, Cr, Mo | Sum | Sb, Sn | Sum | Note |
|---|---|---|---|---|---|---|---|---|---|---|---|---|---|---|---|---|
| A | 0.18 | 0.40 | 1.40 | 0.030 | 0.020 | 0.060 | 0.0033 | 0.013 | 0.0019 | — | — | — | — | — | — | Example |
| B | 0.18 | 0.10 | 0.40 | 0.030 | 0.020 | 0.060 | 0.0033 | 0.013 | 0.0019 | — | — | Cr: 0.95, Ni: 0.20, Mo: 0.15 | 1.30 | — | — | Example |
| C | 0.20 | 0.02 | 0.88 | 0.013 | 0.003 | 0.039 | 0.0033 | 0.013 | 0.0019 | — | — | — | — | — | — | Example |
| D | 0.20 | 0.02 | 0.44 | 0.013 | 0.003 | 0.040 | 0.0033 | 0.013 | 0.0019 | — | — | Cr: 0.50 | 0.50 | — | — | Example |
| E | 0.20 | 0.02 | 0.24 | 0.013 | 0.003 | 0.039 | 0.0033 | 0.013 | 0.0019 | — | — | Cr: 0.95, Mo: 0.15 | 1.10 | — | — | Example |
| F | 0.20 | 0.02 | 0.25 | 0.013 | 0.003 | 0.039 | 0.0033 | 0.002 | 0.0019 | Nb: 0.04, V: 0.04 | 0.08 | — | — | — | — | Example |
| G | 0.24 | 0.02 | 0.25 | 0.013 | 0.003 | 0.039 | 0.0033 | 0.002 | 0.0019 | — | — | — | — | — | — | Example |
| H | 0.28 | 0.02 | 0.22 | 0.015 | 0.003 | 0.039 | 0.0033 | 0.011 | 0.0025 | — | — | — | — | — | — | Example |
| I | 0.20 | 0.02 | 0.88 | 0.013 | 0.003 | 0.039 | 0.0033 | 0.013 | 0.0019 | — | — | — | | Sb: 0.005, Sn: 0.010 | 0.015 | Example |
| J | 0.30 | 0.60 | 1.55 | 0.015 | 0.003 | 0.039 | 0.0033 | 0.011 | 0.0025 | — | — | — | — | — | — | Comparative Example |
| K | 0.28 | 0.02 | 0.22 | 0.015 | 0.003 | 0.039 | 0.0033 | 0.013 | 0.0025 | — | — | Cr: 0.95, Ni: 0.50, Mo: 0.15 | 1.60 | — | — | Comparative Example |
| L | 0.15 | 0.02 | 0.22 | 0.015 | 0.003 | 0.039 | 0.0080 | 0.060 | 0.0025 | Nb: 0.04 V: 0.05 | 0.09 | — | — | — | — | Comparative Example |

TABLE 2

| Steel Sheet No. | Steel No. | Hot Rolling Process: Finish Rolling: Finishing Temperature FT (° C.) | Finish Rolling: Edge Heater | Cooling after Rolling: Mean Cooling Rate (° C./s) | Cooling after Rolling: Edge Cover | Coiling: Coiling Temperature CT (° C.) | Coiling: Coil Cover | Note |
|---|---|---|---|---|---|---|---|---|
| 1 | A | 810 | Not Used | 20 | Not Used | 510 | Not Used | Example |
| 2 | B | 810 | Used | 12 | Not Used | 630 | Not Used | Example |
| 3 | C | 910 | Not Used | 22 | Used | 580 | Not Used | Comparative Example |
| 4 | C | 880 | Used | 14 | Used | 670 | Not Used | Example |
| 5 | C | 850 | Not Used | 15 | Not Used | 630 | Not Used | Example |
| 6 | C | 810 | Not Used | 21 | Used | 490 | Not Used | Comparative Example |
| 7 | D | 850 | Not Used | 12 | Not Used | 670 | Used | Example |
| 8 | E | 870 | Not Used | 13 | Used | 670 | Not Used | Example |
| 9 | F | 880 | Used | 14 | Used | 670 | Used | Example |
| 10 | G | 850 | Used | 12 | Not Used | 670 | Used | Example |
| 11 | H | 860 | Not Used | 13 | Used | 670 | Used | Example |
| 12 | I | 880 | Used | 14 | Used | 670 | Not Used | Example |
| 13 | J | 810 | Not Used | 15 | Used | 580 | Used | Comparative Example |
| 14 | K | 810 | Not Used | 15 | Used | 580 | Used | Comparative Example |
| 15 | L | 810 | Used | 15 | Used | 580 | Used | Comparative Example |

TABLE 3

| Steel Sheet No. | Steel No. | Results: Microstructure: Components* | Ferrite: Mean Grain Diameter (μm) | Ferrite: Fraction (vol. %) | Tensile: Tensile Strength TS** (MPa) | Tensile: ΔTS*** (MPa) | Cold Formability: Estimation of Die Wear | Hardenability: Hardness after Quenching (HV): Controlled Atmospheric quenching | Estimation | Induction Quenching | Estimation | Estimation | Note |
|---|---|---|---|---|---|---|---|---|---|---|---|---|---|
| 1 | A | F + P | 7.5 | 50 | 490 | 58 | ○ | 392 | ○ | 450 | ○ | ○ | Example |
| 2 | B | F + P | 8.6 | 60 | 472 | 45 | ○ | 390 | ○ | 448 | ○ | ○ | Example |
| 3 | C | F + P | 8.2 | 48 | 490 | 62 | ○ | 400 | ○ | 460 | ○ | ○ | Comparative Example |
| 4 | C | F + P | 14.5 | 60 | 440 | 40 | ○ | 403 | ○ | 462 | ○ | ○ | Example |
| 5 | C | F + P | 10.1 | 50 | 470 | 55 | ○ | 405 | ○ | 468 | ○ | ○ | Example |
| 6 | C | F + P + B | 6.8 | 45 | 534 | 70 | x | 410 | ○ | 470 | ○ | ○ | Comparative Example |

TABLE 3-continued

| | | | Results | | | | | | | | | | |
|---|---|---|---|---|---|---|---|---|---|---|---|---|---|
| | | | Microstructure | | | | Cold Formability | Hardenability | | | | | |
| | | | Ferrite | | Tensile | | | Hardness after Quenching (HV) | | | | | |
| Steel Sheet No. | Steel No. | Components* | Mean Grain Diameter (μm) | Fraction (vol. %) | Tensile Strength TS** (MPa) | ΔTS*** (MPa) | Estimation of Die Wear | Controlled Atmospheric quenching | Estimation | Induction Quenching | Estimation | Estimation | Note |
| 7 | D | F + P | 8.1 | 60 | 475 | 43 | ○ | 415 | ○ | 465 | ○ | ○ | Example |
| 8 | E | F + P | 7.8 | 56 | 480 | 45 | ○ | 420 | ○ | 472 | ○ | ○ | Example |
| 9 | F | F + P | 7.0 | 62 | 495 | 39 | ○ | 398 | ○ | 467 | ○ | ○ | Example |
| 10 | G | F + P | 13.6 | 56 | 472 | 41 | ○ | 450 | ○ | 522 | ○ | ○ | Example |
| 11 | H | F + P | 12.4 | 52 | 495 | 42 | ○ | 510 | ○ | 578 | ○ | ○ | Example |
| 12 | I | F + P | 14.4 | 59 | 440 | 40 | ○ | 420 | ○ | 475 | ○ | ○ | Example |
| 13 | J | F + P | 6.5 | 44 | 645 | 71 | x | 520 | ○ | 590 | ○ | ○ | Comparative Example |
| 14 | K | F + P | 6.4 | 45 | 655 | 85 | x | 515 | ○ | 580 | ○ | ○ | Comparative Example |
| 15 | L | F + P | 5.2 | 68 | 595 | 45 | ○ | 328 | x | 398 | x | x | Comparative Example |

*F: Ferrite, P: Pearlite, B: Bainite

**Tensile Strength in the Rolling Direction at the Center Position in the Width Direction

***Deviation of Tensile Strength in the Rolling Direction at Certain Positions in the Width Direction Δ TS = (TS Maximum) − (TS Minimum)

The Examples are all hot-rolled steel sheet having a microstructure consisting of a ferrite and a pearlite in which the mean grain diameter of the ferrite is 7.0 μm or more and 15.0 μm or less and in which the fraction of the ferrite is 50% or more, having tensile strength TS as low as 500 MPa or less, having excellent cold formability, having an advantage that fine blanking can be performed without a decrease in die life, and having excellent hardenability. Moreover, the steel sheet can be used as a material for parts in a high yield, because the variation in tensile strength ΔTS in the width direction is 60 MPa or less, which means that the variation in strength in the width direction is small so that the edge portion of the steel sheet can be used for making parts.

On the other hand, the Comparative Examples outside our range have too high tensile strength TS and low cold formability, cause a decrease in die life for fine blanking, cannot achieve the specified hardness after quenching treatment has been performed, or have a large variation in the strength in the width direction.

The invention claimed is:

1. A hot-rolled steel sheet having a tensile strength of 500 MPa or less and, the steel sheet having a chemical composition comprising, by mass %, C: 0.18% or more and 0.29% or less, Mn: 0.88% or less, S: 0.03% or less, N: 0.0050% or less, Ti: 0.002% or more and 0.05% or less, B: 0.0005% or more and 0.0050% or less, and Si: 0.4% or less, P: 0.1% or less, sol.Al: 0.1% or less, the balance being Fe and inevitable impurities and a microstructure wherein a fraction of ferrite and pearlite with respect to the whole microstructure is 95% or more in terms of a sum of volume fractions of both ferrite and pearlite, wherein mean grain diameter of the ferrite is 7.0 μm or more and 15.0 μm or less, and wherein a volume fraction of the ferrite with respect to the whole microstructure is 50% or more.

2. The hot-rolled steel sheet according to claim 1, wherein the chemical composition further comprises, by mass %, one or both of Nb and V: 0.1% or less in total.

3. The hot-rolled steel sheet according to claim 1, wherein the chemical composition further comprises, by mass %, one or more of Ni, Cr and Mo: 1.5% or less in total.

4. The hot-rolled steel sheet according to claim 1, wherein the chemical composition further comprises, by mass %, one or both of Sb and Sn: 0.1% or less in total.

5. The hot-rolled steel sheet according to claim 1, wherein the steel sheet has a variation in tensile strength ATS of 60 MPa or less throughout a region that is on an inner side 5 mm from edges in a width direction of the steel sheet.

6. A method for manufacturing a hot-rolled steel sheet having a microstructure wherein a fraction of ferrite and pearlite with respect to the whole microstructure is 95% or more in terms of a sum of volume fractions of both ferrite and pearlite, wherein mean grain diameter of the ferrite is 7.0 μm or more and 15.0 μm or less, and wherein a volume fraction of the ferrite with respect to the whole microstructure is 50% or more, comprising:

hot-rolling a steel having a chemical composition comprising, by mass %, C: 0.18% or more and 0.29% or less, Si: 0.4% or less, Mn: 0.88% or less, P: 0.1% or less, S: 0.03% or less, sol.Al: 0.1% or less, N: 0.0050% or less, Ti: 0.002% or more and 0.05% or less, B: 0.0005% or more and 0.0050% or less and the balance being Fe and inevitable impurities with a finishing temperature of 800° C. or higher and 900° C. or lower and thereafter, cooling the resulting hot-rolled steel sheet at a mean cooling rate of 20° C./s or less, and coiling the resulting hot-rolled steel sheet at a coiling temperature CT of 500° C. or higher.

7. The method according to claim 6, wherein the chemical composition further comprises, by mass %, one or both of Nb and V: 0.1% or less in total.

8. The method according to claim 6, wherein the chemical composition further comprises, by mass %, one or more of Ni, Cr and Mo: 1.5% or less in total.

9. The method according to claim 6, wherein the chemical composition further comprises, by mass %, one or both of Sb and Sn: 0.1% or less in total.

10. The hot-rolled steel sheet according to claim 2, wherein the chemical composition further comprises, by mass %, one or more of Ni, Cr and Mo: 1.5% or less in total.

11. The hot-rolled steel sheet according to claim 2, wherein the chemical composition further comprises, by mass %, one or both of Sb and Sn: 0.1% or less in total.

12. The hot-rolled steel sheet according to claim 3, wherein the chemical composition further comprises, by mass %, one or both of Sb and Sn: 0.1% or less in total.

13. The hot-rolled steel sheet according to claim 2, wherein the steel sheet has a variation in tensile strength ΔTS of 60 MPa or less throughout a region that is on an inner side 5 mm from edges in a width direction of the steel sheet.

14. The hot-rolled steel sheet according to claim 3, wherein the steel sheet has a variation in tensile strength ΔTS of 60 MPa or less throughout a region that is on an inner side 5 mm from edges in a width direction of the steel sheet.

15. The hot-rolled steel sheet according to claim 4, wherein the steel sheet has a variation in tensile strength ΔTS of 60 MPa or less throughout a region that is on an inner side 5 mm from edges in a width direction of the steel sheet.

16. The method according to claim 7, wherein the chemical composition further comprises, by mass %, one or more of Ni, Cr and Mo: 1.5% or less in total.

17. The method according to claim 7, wherein the chemical composition further comprises, by mass %, one or both of Sb and Sn: 0.1% or less in total.

18. The method according to claim 8, wherein the chemical composition further comprises, by mass %, one or both of Sb and Sn: 0.1% or less in total.

* * * * *